United States Patent [19]

Chase

[11] 4,046,379

[45] Sept. 6, 1977

[54] SHUTTLE TOY HAVING TWO ORIFICES AND SHOCK ABSORBING MEANS

[75] Inventor: Ascher Chase, Virginia Beach, Va.

[73] Assignee: General Foam Plastics Corporation, Norfolk, Va.

[21] Appl. No.: 668,614

[22] Filed: Mar. 19, 1976

[51] Int. Cl.[2] ..... A63H 33/00

[52] U.S. Cl. ..... 273/95 AA; 46/1 R

[58] Field of Search ..... 46/1 R, 1 H, 1 K, 210; 273/95 AA, 86 D, 86 R; 272/116, 128, 126

[56] References Cited

U.S. PATENT DOCUMENTS

| | | | |
|---|---|---|---|
| 3,737,162 | 6/1973 | Wood | 272/128 |
| 3,743,280 | 7/1973 | Martinez | 272/116 |
| 3,893,256 | 7/1975 | Wolf et al. | 46/1 R |

*Primary Examiner*—F. Barry Shay

*Attorney, Agent, or Firm*—Mandeville and Schweitzer

[57] ABSTRACT

Disclosed herein is an improved slide toy of the type comprising a reciprocatable element which cyclically traverses a straight path defined by a pair of flexible cords passing through the slide element. More specifically, the invention herein is directed to an improved handle construction to which each of the beforementioned cords is secured and an improved line guide means disposed at opposite ends of the slide element and including spaced orifices through which the orifices are threaded.

4 Claims, 4 Drawing Figures

SHUTTLE TOY HAVING TWO ORIFICES AND SHOCK ABSORBING MEANS

BACKGROUND AND SUMMARY OF THE PRESENT INVENTION

Toys which are adapted to be reciprocated along parallel cords between two (or four) users manipulating the cords by handles attached to the ends thereof are known to the art. One specific example of such a toy having a single, axially straight, continuous hole extending completely through a shuttle assembly, which hole of course is greater in diameter than the sum of the diameter of the cords passing therethrough, is shown and described in U.S. Pat. No. 3,743,280. Other versions of the type of shuttle toy described in U.S. Pat. No. 3,743,280 simple comprise a hollow shuttle having single hole at opposite ends thereof through which a pair of cords are extended. The present invention is directed to an improved version of this general type of toy.

Specifically, in accordance with the present invention, the new slide toy is stabilized by the provision of separate orifices at the opposite ends thereof, each of which orifice is not substantially greater than the cord passing therethrough, and in no event exceeds twice the diameter of the cords passing therethrough. In this manner, the cords or flexible track means along which the slide means is adapted to be propelled may be maintained in a substantially stabilized relationship to eliminate or substantially significantly reduce the possibility of yawing, pitching and rolling of the slide element as it travels along the track means.

As a further specific aspect of the present invention, integral shock absorbing means in the nature of collapsible, resilient bellows or like shock absorbing bumpers are integrally molded into the handle structures into which each of the flexible track means is secured.

For a more complete understanding of the principles of the present invention and a better appreciation of the attendant advantages which may be derived from the practice thereof, reference should be made to the following detailed description taken in conjunction with the accompanying drawings.

DETAILED DESCRIPTION OF THE INVENTION

Figure 1:
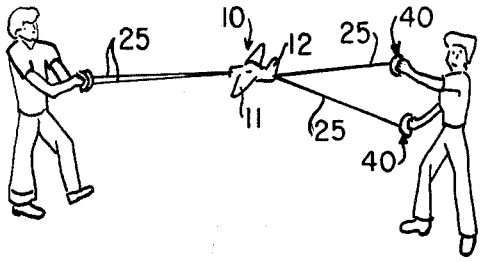
FIG. 1 is a perspective view showing the operation of the slide toy of the present invention by a pair of users.
Figure 2:
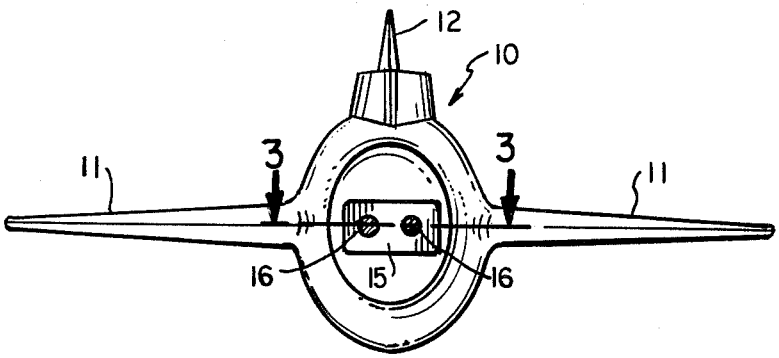
FIG. 2 is a front elevational view of the new improved slide toy taken along line 2—2 of FIG. 1.
Figure 4:
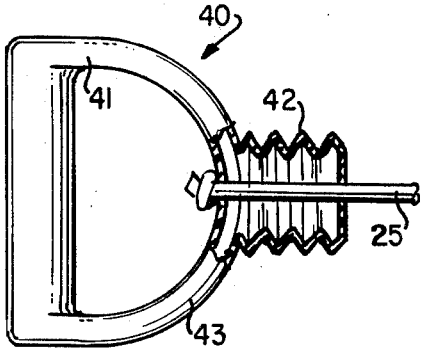
FIG. 4 is a side elevational view of the new and improved handle with parts broken away to show details of construction.

As shown in FIGS. 1 and 2, the slide toy of the present invention comprises a slide element 10, shown in the form of a hollow airplane, having wings 11 and a tail assembly 12. Although illustrated in the specific form of a hollow airplane, the toy may take any desired shape, hollow or otherwise, which may be readily blow-molded or otherwise simply formed by conventional plastic forming technology.

Figure 3:
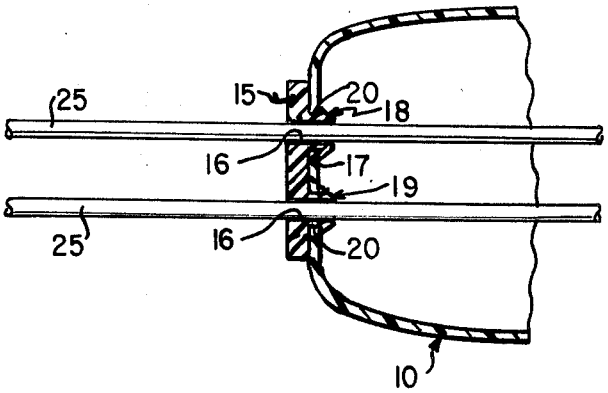
FIG. 3 is an enlarged, fragmentary, cross-sectional view showing details of construction taken along line 3—3 of FIG. 2.

In accordance with the principles of the invention, an insert member 15 having a pair of spaced orifices 16 is inserted in both the forward (nose) and rearward (tail) portions of the slide 10 to provide a stabilizing track guide within the shuttle. More specifically, each of the inserts 15, as shown best in FIG. 3, includes a generally cylindrical projection 17 having self-locking means 18 formed on the free end thereof. In accordance with the invention, the insert 15 is permanently fastened to the slide body 10 by inserting the prongs 19 (formed by the members 17 and 18) through a pair of holes 20 drilled or otherwise formed in the forward and rearwardmost portions of the body 10. As will be understood, the outer diameter of the prong portion 17 is substantially equal to the diameter of the holes 20, while the outer diameter of the self-locking portion is slightly greater than the diameter of the holes 20. whereby the insert 15 may be snapped permanently into place by pushing the prongs through the holes 20 to engage the locking members 18 with the inner surfaces 21 of the slide body 10.

In accordance with the principles of the invention, the diameter of the orifices 16 passing through the insert 15 is slightly and not specifically greater than the diameter of each of the flexible track means 25 which extend through the entire slide body assembly. In no event are the orifices 16 any greater than twice the diameter of the flexible track means or cords 25 which pass through the assembly.

Advantageously, the cords 25 may be of braided or unbraided monofilament construction and, if desired, may be crisscrossed once in their passage through the slide assembly. The enhanced stabilizing and accelerating features of the new toy are only made possible by the provision of four separate orifices for the cords or tracks along which the slide travels.

As is known to the art, slide bodies of the type shown and described herein are capable of reaching high velocities and generating significant momentum as the body reaches the end of its path, ordinarily defined by adjacently held pairs of handles. In order to eliminate shock to the holders of the handles and to enhance the safety of toys of this general type, a new and improved handle structure 40 is provided. As shown best in FIG. 3, the new handle is made of unitary construction and includes a closed loop, D-shaped hand gripping portion 41. Specifically, a shock absorbing bellows 42 is formed at the midpoint of the arcuate portion 43 of the handle. As shown, each of the cords 25 is adapted to pass through the bellows 42 and to be knotted inside the handle to secure the handle to the cord in known fashion. As will be understood, when the shuttle toy approaches and contacts the handle 42, it will engage and tend to collapse the bellows portion 42, which will thereby serve to effectively absorb the shock of impact in accordance with the principles of the invention. Alternatively, and as will be understood, the same assembly shock absorbing characteristics may be obtained by forming the bellows 42 integrally with the insert member 15.

The operation of the new toy is simple. The users, standing approximately 10 to 20 feet apart, merely grasp the opposite ends of the track means 25 through the handles 41 and draw the track means taut to form a straight line path between themselves while bringing the handles together in a side-by-side relation. Thereafter, the slide may be reciprocably propelled along the straight line path back and forth between the users by the coordinated and alternate rapid diversion of the opposite ends of the track means 25. Thus, when one of the users rapidly spreads apart the handle members 41 in his grasp, while the other user maintains the handles in his grasp in a side-by-side relationship (while maintaining tension on the cords 25 to keep them taut), the slide body member 10 will fly along the cords 25 in a stabilized manner since the toy will be traveling on tracks which are disposed in a fixed, spaced relation within the toy body. The process is reversed when the toy reaches the end of the straight line path, as will be understood. It will be appreciated that the potentially hazardous or disconcerting impact of the slide with the handles will be minimized by the inclusion of the integral shock absorbing bellows 42.

While the slide toy construction herein decribed constitutes a preferred embodiment of the present invention, it is understood that the invention is not limited to the precise construction, which is exemplary only, and, therefore, changes may be made therein without departing from the scope of the invention as defined hereinafter in the appended claims.

I claim:

1. A stabilized action mechanism comprising a. first and second flexible track means each having free end portions;

b. a slide body means having forward and aft ends;

c. first and second orifices formed along a horizontal axis of said slide body means in said forward and aft ends;

d. said flexible track means being threaded respectively and independently through said first and second orifices;

e. an independent handle means associated with each of the free end portions of said track means, f. an anchoring means fastening each of said free ends to said handle means; and g. said handle means being in the form of a generally closed loop and including an integrally formed shock absorbing bellows means through which end portions of said track means adjacent said anchoring means are passed;

h. whereby said slide body means is adapted to be propelled along said track means in a substantially straight line course and in a stabilized attitude when a first pair of end portions of said track means is maintained in a substantial side-by-side relationship while the opposite pair of end portions is subjected to rapidly applied divergent tensioning forces.

2. The mechanism of claim 1, further characterized in that a. said slide body means includes a pair of wings and a tail assembly.

3. The mechanism of claim 1, further including a. a wear resistant plug, including two hollow cylindrical projections inserted into each pair of orifices;

b. the ends of said projections including locking barb means.

4. The mechanism of claim 3, in which a. the diameter of each of said cords is not substantially less than the diameter of each of said orifices;

b. the diameter of each of said orifices is less than twice the diameter of each of said cords.

* * * * *